US005131347A

United States Patent [19]

Galindo et al.

[11] Patent Number: 5,131,347

[45] Date of Patent: Jul. 21, 1992

[54] ANCHOR

[76] Inventors: Ramon V. Galindo; Eloy M. Galindo, both of Carimao, La Hacienda, Sector UD 5 Bloque 21, No. 2, Apto 0501, Caracas 1100, Venezuela

[21] Appl. No.: 704,931

[22] Filed: May 23, 1991

[51] Int. Cl.[5] ..... B63B 21/44

[52] U.S. Cl. ..... 114/307

[58] Field of Search ..... 114/298, 304, 306, 303, 114/307, 308, 309, 310

[56] References Cited

U.S. PATENT DOCUMENTS

| | | | |
|---|---|---|---|
| 957,621 | 5/1910 | Neal | 114/303 |
| 2,487,549 | 11/1949 | Hess | 114/208 |
| 3,291,093 | 12/1966 | Wood, Jr. | 114/208 |
| 3,336,893 | 8/1967 | Hallauer | 114/298 |
| 3,509,846 | 5/1970 | Hrivnyak et al. | 114/298 |
| 3,822,665 | 7/1974 | Hungerford | 114/310 |
| 3,902,446 | 9/1975 | van den Haak | 114/208 R |
| 4,029,040 | 6/1977 | Klaren | 114/304 |
| 4,058,078 | 11/1977 | Stelling | 114/303 |
| 4,058,078 | 11/1977 | Stelling | 114/304 X |
| 4,073,256 | 2/1978 | Rossini | 114/306 |
| 4,385,584 | 5/1983 | Simpson, III | 114/306 |
| 4,644,894 | 2/1987 | Woodgate | 114/304 |

*Primary Examiner*—Sherman Basinger

*Attorney, Agent, or Firm*—Dennison, Meserole, Pollack & Scheiner

[57] ABSTRACT

An improved anchor comprising a central longitudinal stem, or flat bar, two cylindrical bars arranged symmetrically near one end of the flat bar and in a transversal sense, two triangular-shaped flukes each with a tubular base for insertion on the cylidnrical bars, the axial displacement being limited by washers and pins, each fluke turning independently with an amplitude between the flukes of at least 120°, the amplitude determined by the distance of two triangular tops from the central stem.

4 Claims, 2 Drawing Sheets

ANCHOR

BACKGROUND OF THE INVENTION

This invention is related to anchors provided with pivoted flukes capable to turn independently and being easily assembled; the flukes are kept in their axial position by means of fast release joints.

There are different types of anchors for vessels, the usual and more common anchor being one which is defined by a cross-like piece with penetration flukes normally fused to a common body turned relative to a central stem. Two types of anchors can be distinguished as follows:

a) Those that have non-removable flukes fused to a body, such as those illustrated in U.S. Pat. Nos. 4,644,894 of Bryan F. Woodgate; 3,291,093 of John M. Wood. Jr.,; 2,487,549 of Henry Laurence Hess;

b) Those which have removable flukes joined by coupling elements to a body for turning in common, thus maintaining the relative position between them fixed, such as the ones illustrated in U.S. Pat. Nos. 4,385,584 of Lee S. Simpson; 4,073,256 of alfred P. Rossini; 4,058,078 of William Stelling; 4,029,040 of Petrus Josef Klaren; 3,902,446 of Rob Van Den Haak.

The purpose of the present invention is to provide an anchor which because of its pivoted flukes capable of independently turning, improve the penetration capacity and grip to the aquatic subsoil, thereby increasing the fastening possibility because when one of the flukes grips into the irregularities of the subsoil, the other fluke will adapt itself to any irregularity of the same surface until it clasps at another level without interfering with the fastening of the other fluke.

DESCRIPTION OF THE PREFERRED EMBODIMENT

Figure 1:
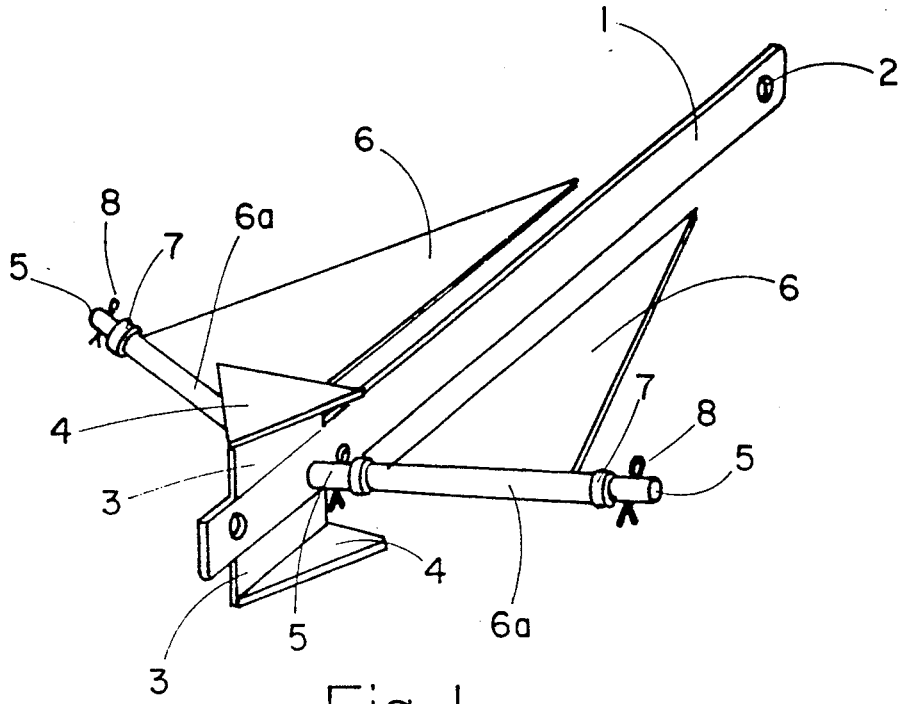
FIG. 1 is a perspective view of the improved anchor, object of the invention.
Figure 2:
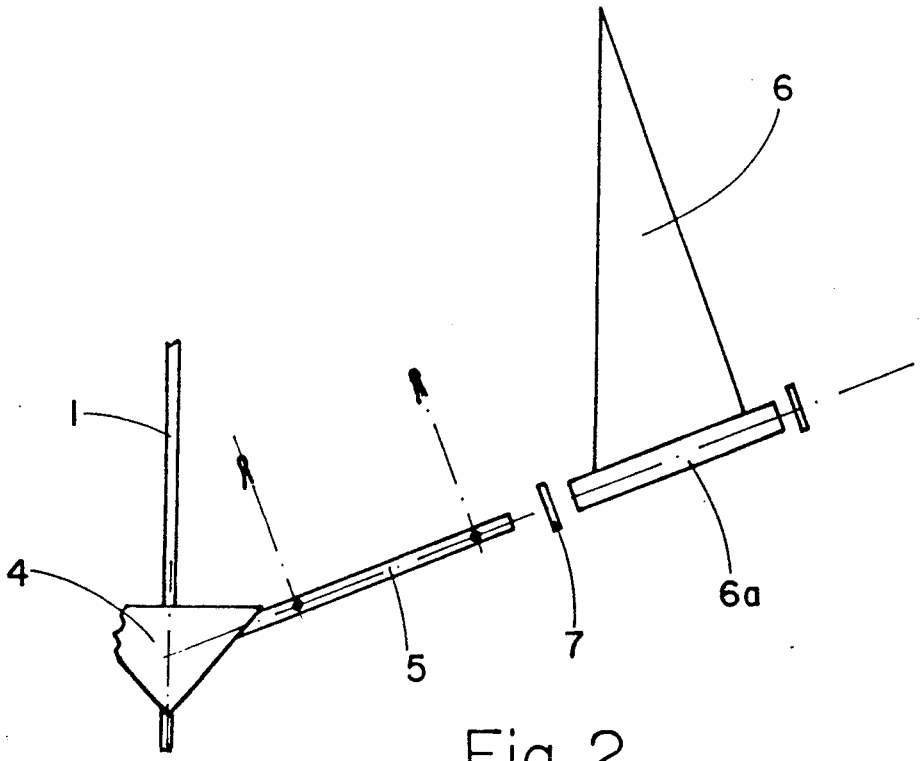
FIG. 2 is a partial expanded view of the anchor with one of its flukes disassembled.
Figure 3:
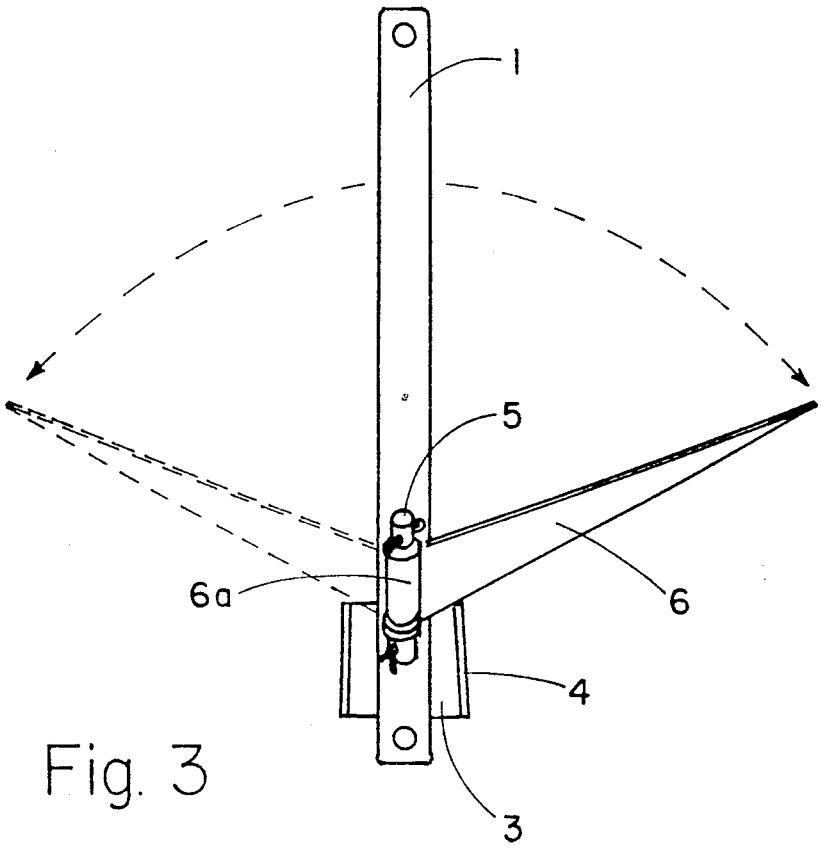
FIG. 3 is a lateral view of the anchor showing the independent turns of flukes.
Figure 4:
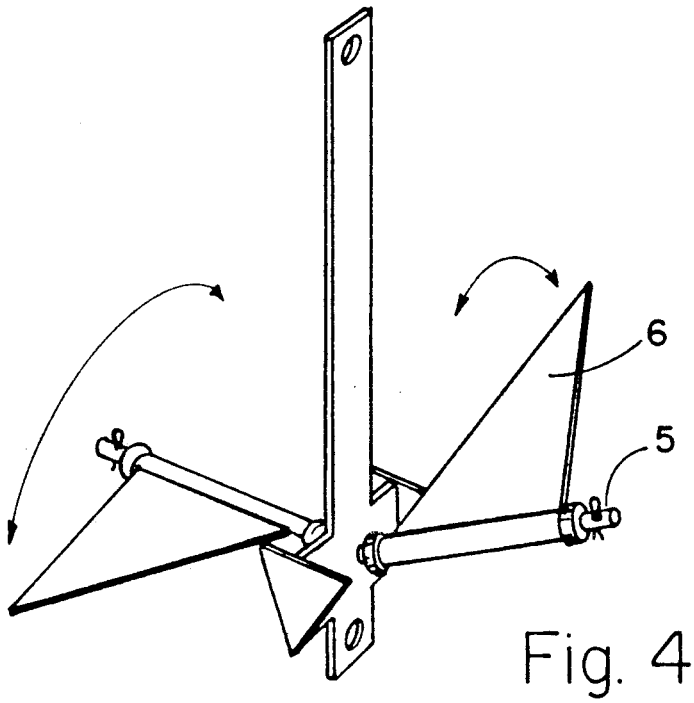
FIG. 4 is a perspective view of the anchor from a different angle showing the independent turns of flukes.

FIG. 1 shows the anchor in assembled form. A central longitudinal stem such as a flat bar having narrow edges (1) has at one end two trapezoidal plates (3) welded symmetrically to the narrow edges. Perpendicular to each of these plates is coupled or welded a triangularly shaped flat top (4). To both of the flat sides of the bar (1) are joined cylindrical bars (5) serving as axes for two flukes (6). The cylindrical bars are preferably tilted toward the other end of the flat plate. Each fluke has a tubular base (6*a*) and is supported by the cylindrical bar so that each fluke is independently rotatable. The axial displacement of the tubular bars (6*a*) is limited by two flat washers (7) and pins (8) such as cotter pins inserted into holes provided in cylindrical bars (5). The aforementioned flat top (4) operates to limit the turning angle of each fluke. Holes at each end of the flat plate provide for attachment of a rope.

The performance of this improved anchor allows the maximum and best fastening of the vessel in any type of aquatic bottom. The dragging produced by the vessel on the anchor through the rope will determine the hooking up of one of the flukes (6), in any irregularity of the subsoil which it happens to find; however, there is a turning limit determined by the triangular flat tops (4) which will prevent the dragging.

The other fluke, in turn, as being independent will fasten in any obstacle under it. On the other hand, when a lateral dragging of the anchor takes place which makes it turn, there will always be one of the flukes (6) fastened, around which the rest of the anchor pieces will turn, until the tension produced along the central stem (1) will again cause the grasping of both flukes (6).

We claim:

1. An improved anchor comprising:

a flat longitudinal central stem having perforations near its ends;

two symmetrical trapezoidal plates welded near the one end of said stem for determining a distance;

two symmetrical triangular flat tops coupled perpendicularly to said trapezoidal plates;

two cylindrical bars positioned transversal to said stem near its one end;

two triangular flukes with tubular based mounted on said transversal cylindrical bars, and locking means for preventing the axial displacement of the flukes; each locking means including a washer and pin, and said triangular flukes turning independently and having a maximum turn amplitude between each other of at least 120°.

2. The improved anchor, as in claim 1, wherein said turn amplitude is determined by the distance of said triangular flat tops from said central stem.

3. The improved anchor, as in claim 1, wherein said triangular tops are convergently oriented toward the other end of said longitudinal central stem.

4. The improved anchor, as in claim 1, wherein said transversal cylindrical bars are symmetrical with respect to said longitudinal central stem and are tilted toward the other end of the longitudinal central stem forming between each other, an angle of more then 90°.

* * * * *